US006688211B1

(12) United States Patent
Viet

(10) Patent No.: US 6,688,211 B1
(45) Date of Patent: Feb. 10, 2004

(54) DUAL LINEAR ACTUATOR

(76) Inventor: Vu H. Viet, 915 Brittany Pl., Fort Wayne, IN (US) 46825

( * ) Notice: Subject to any disclaimer, the term of this patent is extended or adjusted under 35 U.S.C. 154(b) by 40 days.

(21) Appl. No.: 10/078,570

(22) Filed: Feb. 20, 2002

(51) Int. Cl.[7] ..... F01B 7/20
(52) U.S. Cl. ..... 92/51; 92/65; 92/151
(58) Field of Search ..... 91/169; 92/51, 92/65, 151, 152

(56) References Cited

U.S. PATENT DOCUMENTS

| | | | | | |
|---|---|---|---|---|---|
| 2,676,573 A | * | 4/1954 | Abbe | ..... | 92/52 |
| 4,756,238 A | * | 7/1988 | Naruse et al. | ..... | 92/151 |
| 4,984,509 A | * | 1/1991 | Hoshi | ..... | 92/107 |

FOREIGN PATENT DOCUMENTS

| | | | | |
|---|---|---|---|---|
| DE | 2257450 | * 11/1972 | ..... | 92/108 |
| DE | 2522560 | * 12/1976 | ..... | 92/108 |
| SU | 276670 | * 10/1970 | ..... | 92/51 |

* cited by examiner

*Primary Examiner*—F. Daniel Lopez

(57) ABSTRACT

A dual linear actuator for allowing a tool to perform multiple actions either simultaneously or independently of one another. The dual linear actuator includes an outer tubular housing having open first and second ends and also having a bore extending therethrough; and also includes an inner tubular housing being securely disposed in the bore of the outer tubular housing and having open first and second ends and also having a bore extending therethrough; and further includes a first cap being removably attached to the first ends of the outer and inner tubular housings; and also includes a second cap having a side wall and being removably attached to the second end of the inner tubular housing; and further includes a third cap having a side wall and being removably attached to the second end of the outer tubular housing; and also includes a first piston assembly including a tubular piston being movably disposed in the bore of the outer tubular housing; and further includes a second piston assembly including a piston member being movably disposed in the bore of the inner tubular housing.

2 Claims, 7 Drawing Sheets

DUAL LINEAR ACTUATOR

BACKGROUND OF THE INVENTION

1. Field of the Invention

The present invention relates to dual linear actuators and more particularly pertains to a new dual linear actuator for allowing a tool to perform multiple actions either simultaneously or independently of one another or to combine with other devices by inserting into its opening center of the hollow actuator.

2. Description of the Prior Art

The use of dual linear actuators is known in the prior art. More specifically, dual linear actuators heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,037,821; U.S. Pat. No. 5,406,880; U.S. Pat. No. 191,516; U.S. Pat. No. 2,487,920; U.S. Pat. No. 4,516,468; and U.S. Pat. No. Des. 293,877.

While these devices fulfill their respective, particular objectives and requirements, the aforementioned patents do not disclose a new dual linear actuator. The inventive device includes an outer tubular housing having open first and second ends and also having a bore extending therethrough; and also includes an inner tubular housing being securely disposed in the bore of the outer tubular housing and having open first and second ends and also having a bore extending therethrough; and further includes a first cap being removably attached to the first ends of the outer and inner tubular housings; and also includes a second cap having a side wall and being removably attached to the second end of the inner tubular housing; and further includes a third cap having a side wall and being removably attached to the second end of the outer tubular housing; and also includes a first piston assembly including a tubular piston being movably disposed in the bore of the outer tubular housing; and further includes a second piston assembly including a piston member being movably disposed in the bore of the inner tubular housing; and allows for multiple actions being placed upon various tools essentially simultaneously, features not described nor suggested in any of the prior art.

In these respects, the dual linear actuator according to the present invention substantially departs from the conventional concepts and designs of the prior art, and in so doing provides an apparatus primarily developed for the purpose of for allowing a tool to perform multiple actions either simultaneously or independently of one another.

SUMMARY OF THE INVENTION

The general purpose of the present invention, which will be described subsequently in greater detail, is to provide a new dual linear actuator apparatus and method which has many of the advantages of the dual linear actuators mentioned heretofore and many novel features that result in a new dual linear actuator which is not anticipated, rendered obvious, suggested, or even implied by any of the prior art dual linear actuators, either alone or in any combination thereof.

There has thus been outlined, rather broadly, the more important features of the dual linear actuator in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new dual linear actuator apparatus and method which has many of the advantages of the dual linear actuators mentioned heretofore and many novel features that result in a new dual linear actuator which is not anticipated, rendered obvious, suggested, or even implied by any of the prior art dual linear actuators, either alone or in any combination thereof.

Still another object of the present invention is to provide a new dual linear actuator for allowing a tool to perform multiple actions either simultaneously or independently of one another.

Still yet another object of the present invention is to provide a new dual linear actuator that is easy and convenient to manipulate and use.

Even still another object of the present invention is to provide a new dual linear actuator that eliminates the user having to have multiple actuators to have the attachment tools perform multiple actions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
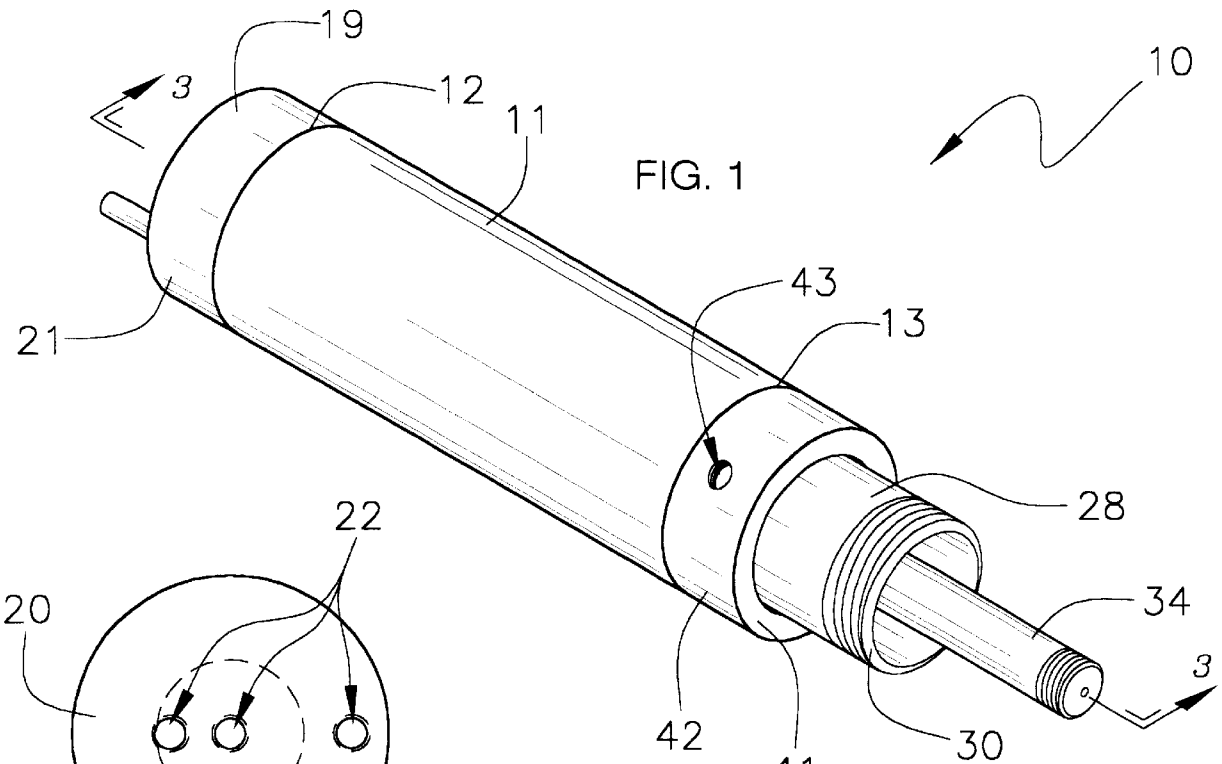
FIG. 1 is a perspective view of a new dual linear actuator according to the present invention.
Figure 2:
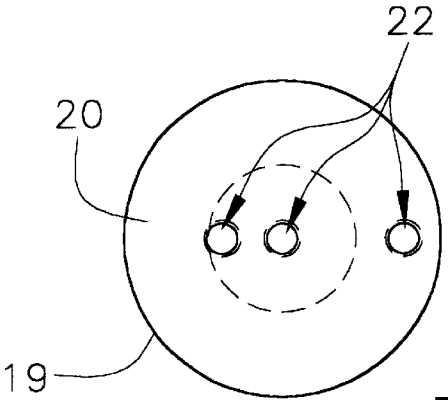
FIG. 2 is a first end elevational view of the present invention.
Figure 3:
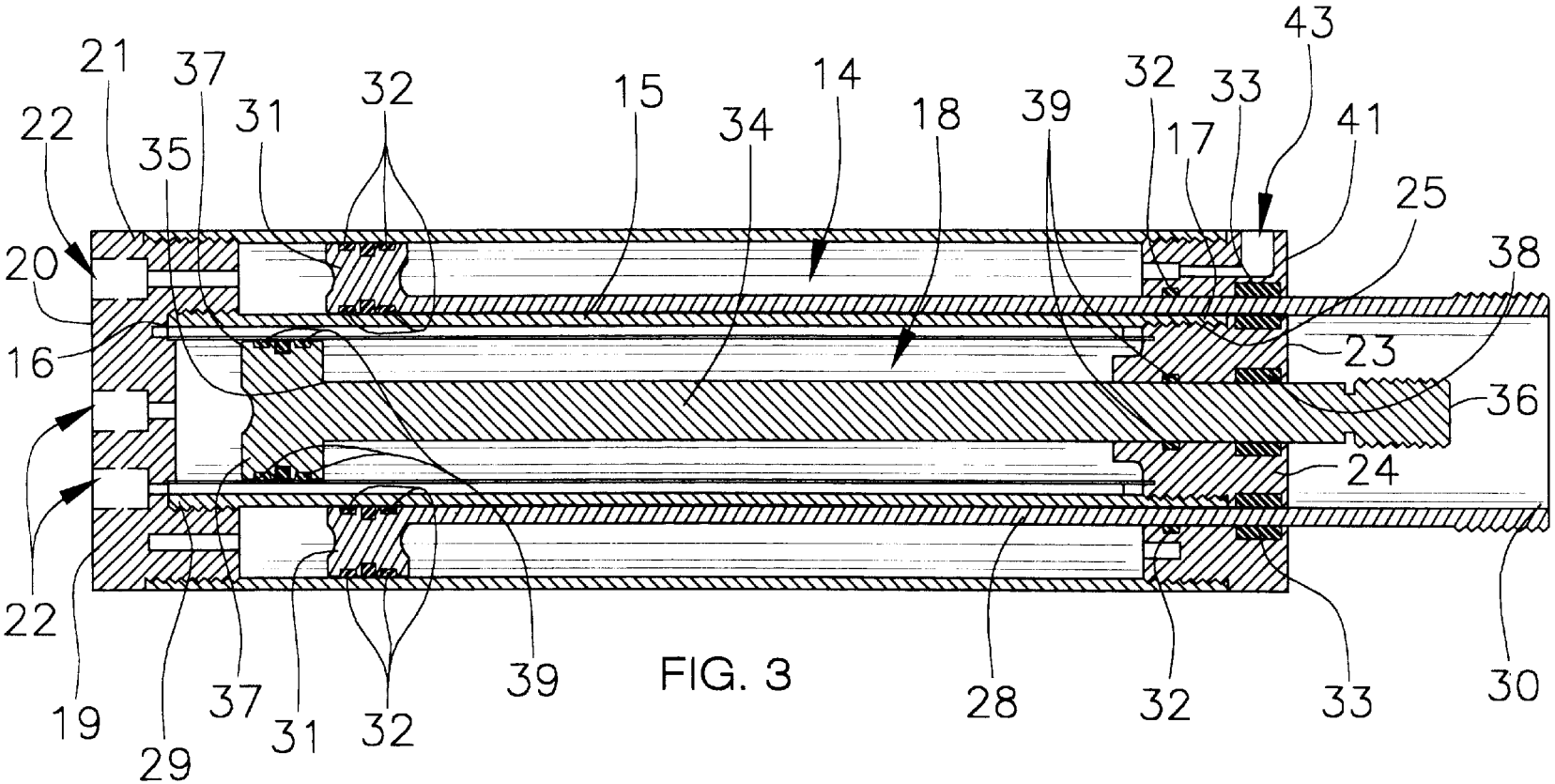
FIG. 3 is a longitudinal cross-sectional view of the present invention.
Figure 4:
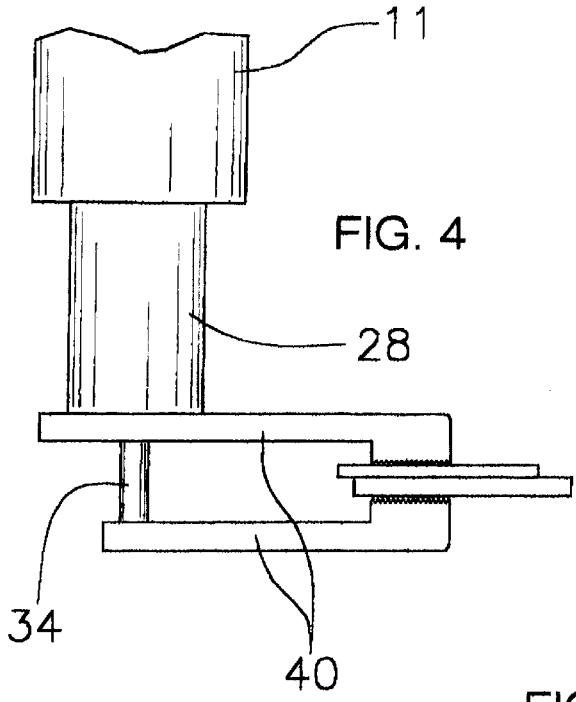
FIG. 4 is a partial side elevational view of the present invention shown connected to an attachment device and shown in use.
Figure 5:
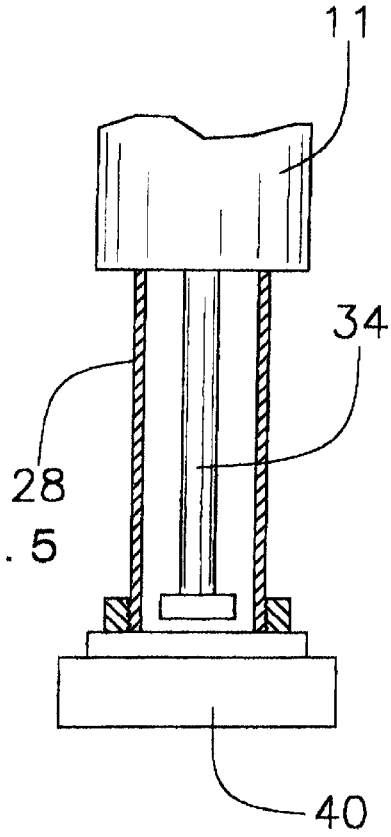
FIG. 5 is a partial longitudinal cross-sectional view of the present invention shown in use.
Figure 6:
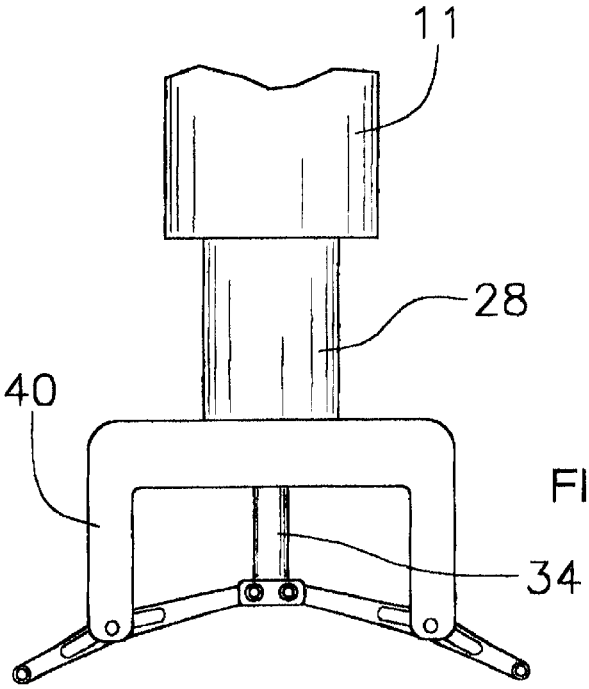
FIG. 6 is another partial side elevational view of the present invention shown in use.
Figure 7:
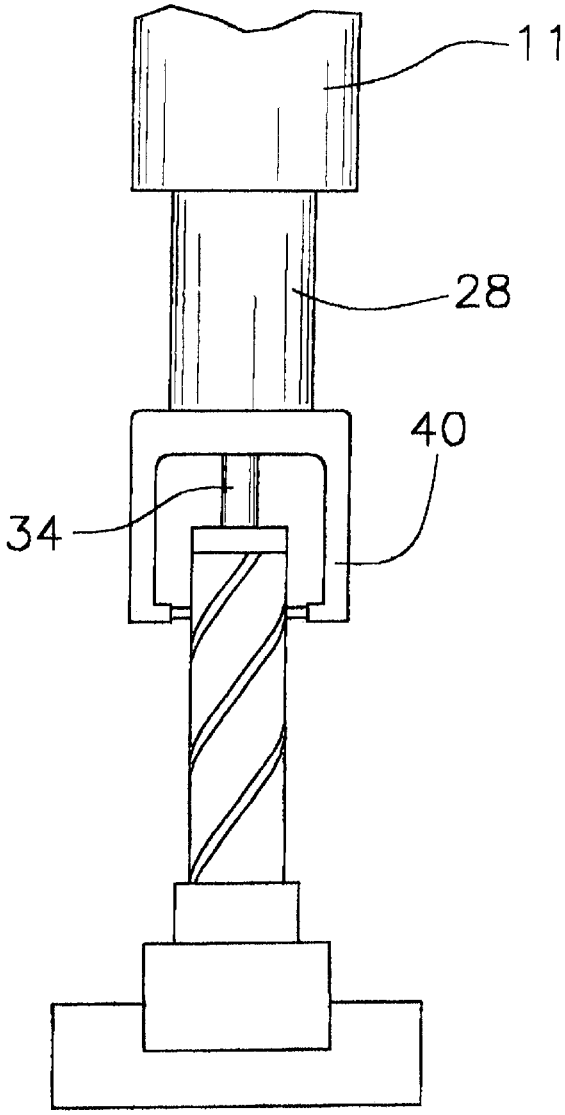
FIG. 7 is yet another partial side elevational view of the present invention shown in use.
Figure 8:
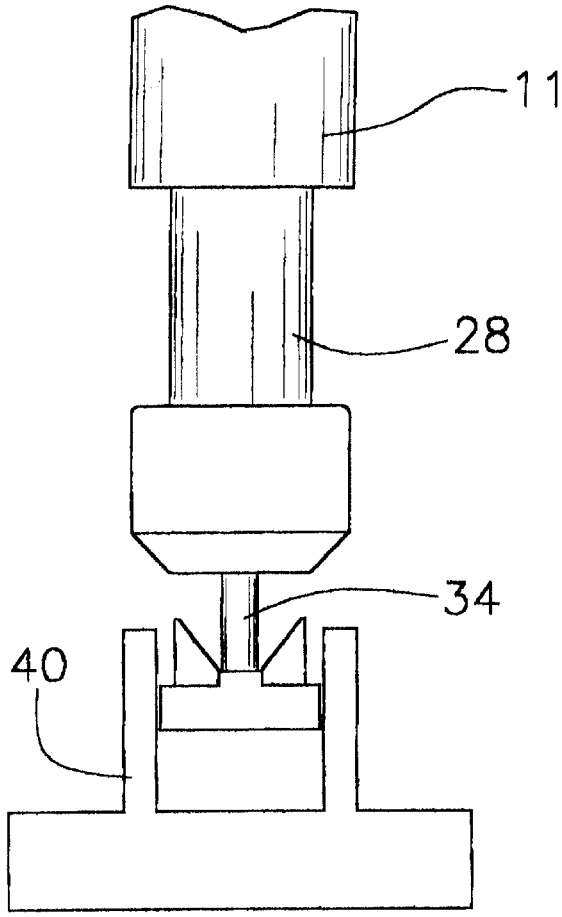
FIG. 8 is a still another partial elevational view of the present invention shown in use.
Figure 9:
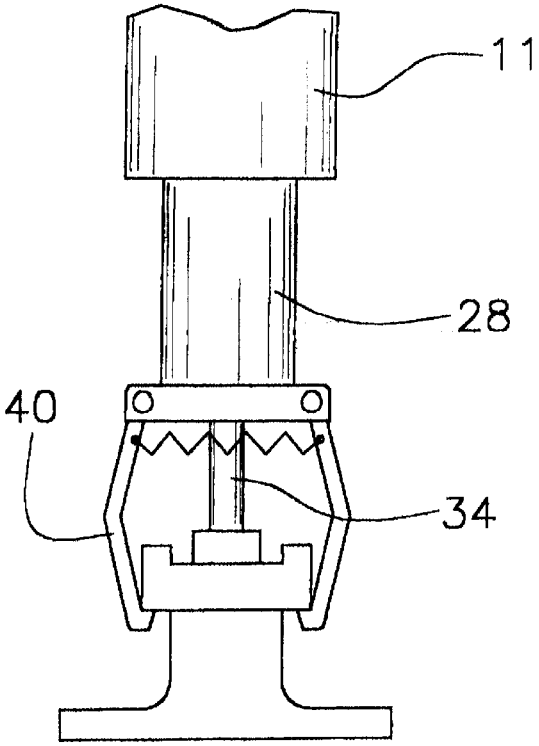
FIG. 9 is a partial elevational view of the present invention shown in use.
Figure 10:
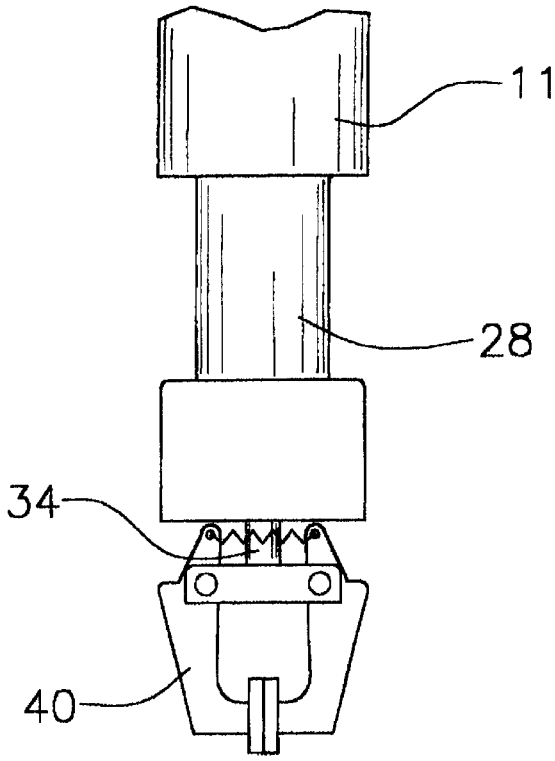
FIG. 10 is a partial side elevational view of the present invention shown in use.
Figure 11:
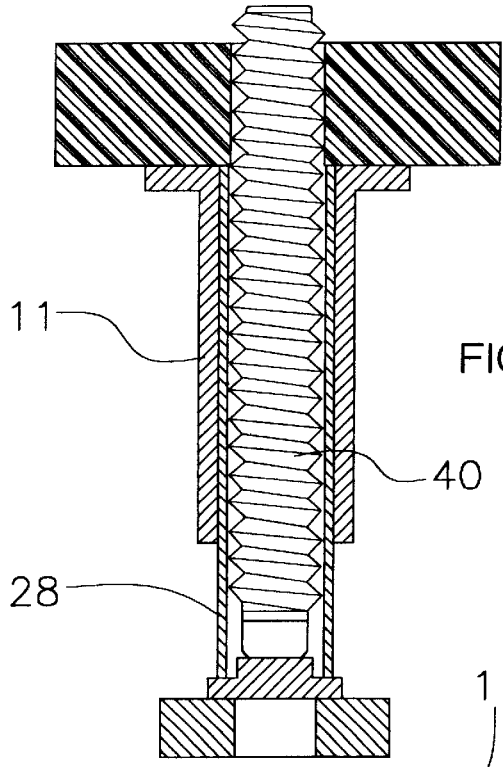
FIG. 11 is a longitudinal cross-sectional view of the present invention shown in use.
Figure 12:
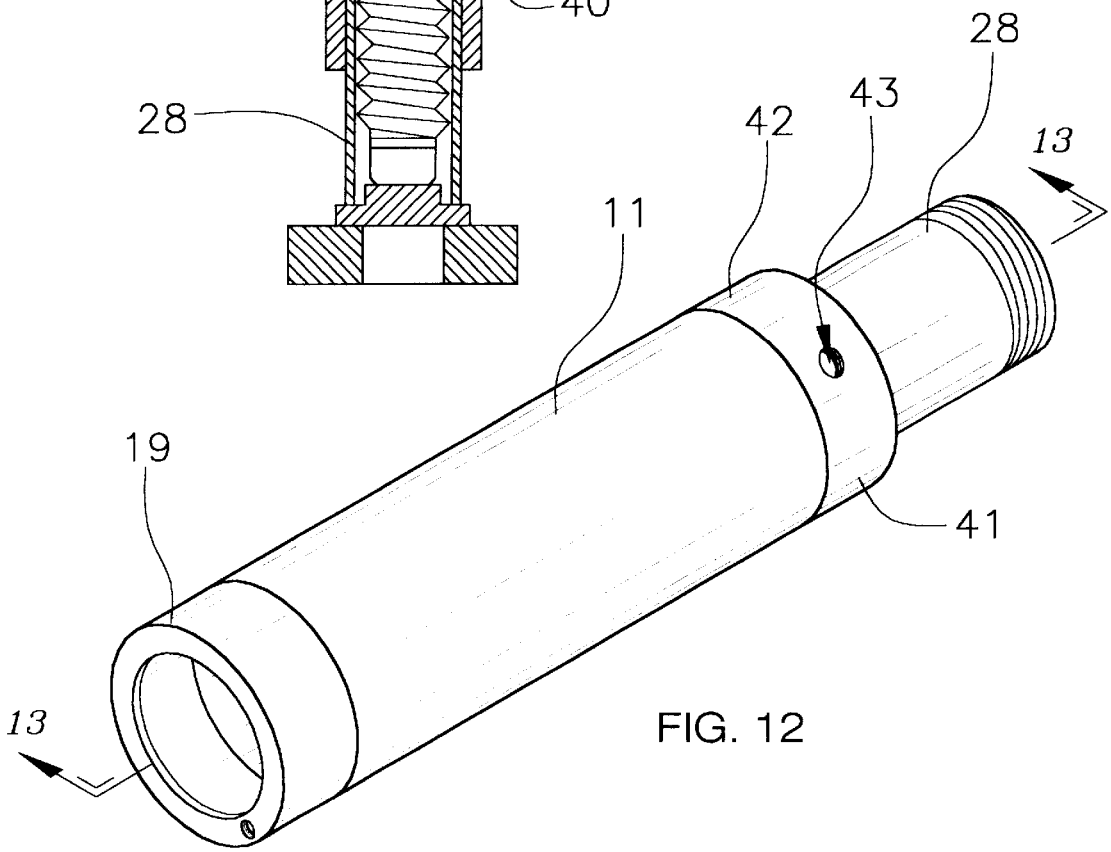
FIG. 12 is a perspective view of the present invention.
Figure 13:
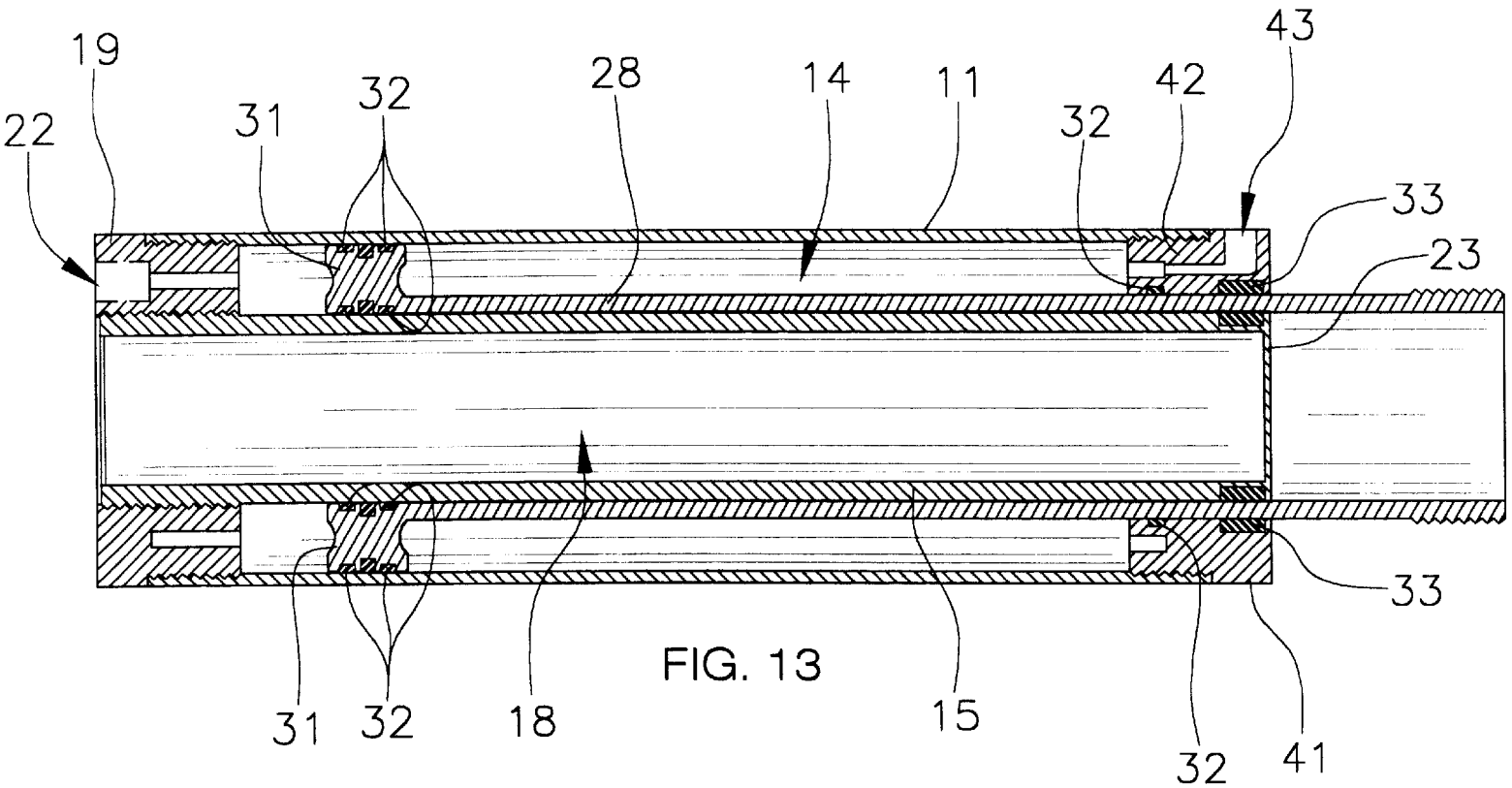
FIG. 13 is a perspective view of the tubular housing and tubular piston of the present invention.

With reference now to the drawings, and in particular to FIGS. 1 through 13 thereof, a new dual linear actuator embodying the principles and concepts of the present invention and generally designated by the reference numeral 10 will be described.

As best illustrated in FIGS. 1 through 13, the dual linear actuator 10 generally comprises an outer tubular housing 11 having open first and second ends 12,13 and also having a bore 14 extending therethrough. An inner tubular housing 15 is securely and conventionally disposed in the bore 14 of the outer tubular housing 11 and having open first and second ends 16,17 and also having a bore 18 extending therethrough.

A first cap 19 is removably and conventionally attached to the first ends 12,16 of the outer and inner tubular housings 11,15. The first cap 19 includes a main wall 20 and a side wall 21 integrally extending outwardly along a perimeter of the main wall 20 and having threads disposed thereupon. The first cap 19 is threaded upon the first ends 12,16 of the outer and inner tubular housings 11,15. The first cap 19 further includes a plurality of fitting-receiving ports 22 being disposed through the main wall 20 thereof.

A second cap 23 is removably and conventionally attached to the second end 17 of the inner tubular housing 15. The second cap 23 includes a main wall 24 and a side wall 25 integrally extending outwardly along a perimeter of the main wall 24 and having threads disposed thereupon. The second cap 23 is threaded upon the second end 17 of the inner tubular housing 15. The second cap 23 includes an opening being disposed through the main wall 24. A third cap 41 having a side wall 42 is removably and conventionally attached to the second end 13 of the outer tubular housing 11. The third cap 41 is a ring having threads disposed upon the side wall 42 thereof and also having an opening extending therethrough, and further having a fitting-receiving port 43 being disposed through the side wall 42 thereof and being aligned with the bore 14 of the outer tubular housing 11.

A first piston assembly includes a tubular piston rod 28 being movably disposed in the bore 14 of the outer tubular housing 11. The first piston assembly also includes first piston member 31 being conventionally attached to an exterior of a wall and near a first end 29 of the tubular piston rod 28, and further includes first seal members 32 being engaged between the first piston member 31 and the inner and outer tubular housings 11,15, and also being engaged between the side wall 42 of the third cap 41 and the inner tubular housing 15 to prevent leakage of fluid from the outer tubular housing 11. The first piston assembly also includes first bearings 33 being conventionally attached to the third cap 41 and to the inner tubular housing 15 and through which the wall of the tubular piston rod 28 is movable. The exterior of the wall of the tubular piston rod 28 is threaded at a second end 30 thereof for easy attachment to various tools 40.

A second piston assembly includes a piston rod 34 being movably disposed in the bore 18 of the inner tubular housing 15. The piston rod 34 is a shaft being threaded at a second end 36 thereof for easy attachment to various tools 40. The second piston assembly further includes second piston member 37 being integrally attached at a first end 35 of the piston rod 34 for moving the piston member 34 in the inner tubular housing 15, and also includes a second bearing 38 being conventionally disposed in the second cap 23 and through which the piston rod 34 is movably extended, and further includes second seal members 39 being conventionally engaged between the inner tubular housing 15 and the second piston member 37 and also between the piston rod 34 and the second cap 23 to prevent leakage of fluid from the bore 18 of the inner tubular housing 15.

In use, the user attaches the fitting-receiving ports 22,43 to hoses which are connected to a conventional hydraulic pump and reservoir, and also conventionally connects the second ends 30,36 of the tubular piston 28 and the piston rod 34 to certain parts of a tool 40 to be used to perform a particular task such as clamping about selected work pieces. The user then allows the hydraulic pump to feed fluid into the fitting-receiving ports 22,43 to move the tubular piston rod 28 and the piston member 30 in the manner to work and manipulate the tool 40.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the dual linear actuator. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dual linear actuator comprising:

an outer tubular housing having open first and second ends and also having a bore extending therethrough;

an inner tubular housing being securely disposed in said bore of said outer tubular housing and having open first and second ends and also having a bore extending therethrough;

a first cap being removably attached to said first ends of said outer and inner tubular housings;

a second cap having a side wall and being removably attached to said second end of said inner tubular housing;

a third cap having a side wall and being removably attached to said second end of said outer tubular housing;

a first piston assembly including a tubular piston rod being movably disposed in said bore of said outer tubular housing, said first piston assembly also including first piston member being attached to an exterior of a wall and near a first end of said tubular piston rod, and further including first seal members being engaged between said first piston member and said inner and outer tubular housings, and also being engaged between said side wall of said third cap and said inner tubular housing to prevent leakage of fluid from said outer tubular housing, said first piston assembly also including first bearings being attached to said third cap and to said inner tubular housing and through which a wall of said tubular piston is movable; and a second piston assembly including a piston rod member being movably disposed in said bore of said inner tubular housing.

2. A dual linear actuator as described in claim 1, wherein said exterior of said wall of said tubular piston rod is threaded at a second end thereof for easy attachment to various tools.

* * * * *